United States Patent [19]

Crum et al.

[11] Patent Number: 5,056,720

[45] Date of Patent: Oct. 15, 1991

[54] ELECTROSTATIC SPRAY GUN

[75] Inventors: Gerald W. Crum; John C. A. Traylor, both of Elyria, Ohio

[73] Assignee: Nordson Corporation, Westlake, Ohio

[21] Appl. No.: 585,241

[22] Filed: Sep. 19, 1990

[51] Int. Cl.[5] ..... B05B 5/053

[52] U.S. Cl. ..... 239/698; 239/708; 239/600

[58] Field of Search ..... 239/690, 697, 698, 708, 239/600, 704, 706, 707

[56] References Cited

U.S. PATENT DOCUMENTS

| | | | |
|---|---|---|---|
| 4,120,016 | 10/1978 | Hendricks | 361/228 |
| 4,120,017 | 10/1978 | Sickles | 361/228 |
| 4,171,098 | 10/1979 | Braun | 239/708 |
| 4,290,091 | 9/1981 | Malcolm | 239/690 |
| 4,634,058 | 1/1987 | Hollstein et al. | 239/697 |
| 4,682,735 | 7/1987 | Mommsen | 239/690 |
| 4,752,034 | 6/1988 | Kuhn et al. | 239/690 |
| 4,978,075 | 12/1990 | Lind et al. | 239/690 |
| 4,993,645 | 2/1991 | Buschor | 239/708 |

*Primary Examiner*—Andres Kashnikow

*Assistant Examiner*—Karen B. Merritt

*Attorney, Agent, or Firm*—Wood, Herron & Evans

[57] ABSTRACT

An electrostatic spray gun is provided that alternatively houses an end section of a high voltage cable remotely supplied by a high voltage source or an internal voltage multiplier so the electrode of the gun may be alternatively powered by the high voltage output of the end section of the high voltage cable or the internal voltage multiplier. The gun has an internal chamber into which the internal voltage multiplier or end section of the high voltage cable may be alternatively placed. A resistor-/electrode assembly is mounted onto the high voltage output of the internal voltage multiplier or end section of the high voltage cable. A retainer secures the internal voltage multiplier or end section of the high voltage cable within the internal chamber and also maintains the electrical contact between the resistor/electrode assembly and the high voltage output housed within the internal chamber. The internal voltage multiplier and end section of the high voltage cable are configured relative the internal chamber to prevent rotation so that electrical contact between the resistor/electrode assembly and the high voltage output housed within the internal chamber is further maintained.

14 Claims, 5 Drawing Sheets

ELECTROSTATIC SPRAY GUN

BACKGROUND OF THE INVENTION

Electrostatic spray guns used for charging particles of a coating material emitted from the gun are well known. To attract the coating material to the article to be covered, the coating particles are charged to the opposite polarity of the article to be coated. Early forms of electrostatic spray guns were powered from remote high-voltage dc supplies that provided output voltages of 70 kilovolts (KV) or higher. The output voltage of such power supplies was conducted via high voltage cables to particle-charging electrodes mounted proximate the nozzles of the guns. These high voltage cables typically were stiff, making the gun difficult to maneuver, and stored potentially dangerous levels of electrical energy which created shock and ignition hazards.

To provide a safer and more maneuverable gun, miniaturized voltage multiplier circuits operating at high frequency were developed that could fit within the electrostatic spray gun to produce the requisite high dc charging voltage from a relatively low input voltage. Such guns with internal high voltage multiplication capabilities are generally powered from either an external low voltage power supply via a low voltage cable to the gun which is more flexible than high voltage cables, or a low voltage power supply, such as a battery, located within the gun which eliminates a cable altogether. The internal high voltage circuit steps up the low input voltage by means of a transformer, rectifies and multiplies the stepped-up voltage in a diode/capacitor multiplier cascade, and outputs a high dc voltage to the particle-charging electrode of the gun.

Electrostatic guns with internal voltage multiplier circuits are particularly advantageous for manual spray coating applications since the guns are more maneuverable than guns supplied from external high voltage power supplies having stiff and bulky high voltage cables. However, maneuverability is not generally a consideration in applications where the gun is robot-controlled or machine-reciprocated, and as a consequence in such installations it is common to use external high voltage power supplies.

Historically, electrostatic spray gun manufacturers marketing both manual and robot-controlled or machine-reciprocated guns had to manufacture guns of entirely different construction for these two different applications. The additional tooling and parts inventory required to support the manufacture of two different gun constructions unnecessarily increased the cost of gun manufacture.

SUMMARY OF THE INVENTION

The present invention provides a single electrostatic spray gun construction that can be alternatively powered from either a high voltage external supply or an internal high voltage multiplier circuit fed from an external low voltage source. Such a spray gun has a common set of gun parts which are used in either mode, so only the power supply components need be changed. An electrostatic spray gun constructed according to the principles of the present invention incorporates modular electrical components for quick disassembly, insertion of the desired form of power supply, and reassembly.

More particularly, the electrostatic spray gun of this invention includes a housing having an internal chamber which houses either an internal voltage multiplier or the end section of an externally powered high voltage cable, as desired, a retainer for alternatively securing within the chamber either the internal voltage multiplier or the end section of the externally powered high voltage cable, and a modular gun resistor/electrode assembly connectable to either the output of the internal high voltage multiplier or the end of the externally powered high voltage cable. The internal voltage multiplier, if used, has its input connected to either an internal low voltage power source located within the gun housing, such as a battery, or to a low voltage cable inserted in the gun housing which connects to an external low voltage source. When the high voltage cable is used, it directly interconnects the gun resistor/electrode assembly and the external high voltage source.

In accordance with one aspect of the present invention, the internal voltage multiplier is provided with a heat conductive band having a tab extending therefrom to collect heat generated within the internal voltage multiplier. The tab extending from the heat conductive band is connected to a heat dissipation member which incorporates a hook with a substantial portion of the heat dissipation member exposed outside the gun housing to dissipate the collected heat thermally conducted to the heat dissipation member by the tab.

In accordance with another aspect of the invention, the tab extending from the heat conductive band is connected to the heat dissipation member by a fastener that also secures the heat dissipation member to the gun housing.

In accordance with a still further aspect of the invention, the gun housing has two sections, a barrel and a handle, that are held together by the heat dissipation member through the incorporation of a first fastener that secures the tab extending from the internal voltage multiplier to the heat dissipation member and the heat dissipation member to the handle and a second fastener that secures the heat dissipation member to the barrel.

In accordance with a further aspect of the invention, the internal voltage multiplier and the end section of the high voltage cable alternatively housed within the internal chamber are configured relative to the internal chamber to prevent rotation of either one within the internal chamber, thereby enabling a threaded retainer to be conveniently used for securing the internal voltage multiplier or the end section of the high voltage cable within the internal chamber of the gun.

In accordance with a further aspect of the invention, the gun housing has a barrel that contains the forward end of the internal chamber and a bore located forward of the internal chamber which are separated by a divider wall having an opening therein. The rearward end of a gun resistor/electrode assembly is mounted to the forward end of either one of the high voltage cable end section or the internal voltage multiplier extending into the bore through the opening in the wall. The rearward end of a retaining member located forward of the divider wall engages the forwardmost portion or tip of the high voltage cable end section or the high voltage output of the internal voltage multiplier, as the case may be, which extends into the bore through the divider wall, thereby releasably retaining the high voltage cable end section or the multiplier circuit, as the case may be, within the internal chamber. Since the high voltage cable end section or voltage multiplier, depending upon which is being used, and the resistor/electrode assembly mounted thereon are fixed relative the divider wall, the electrical connection between the gun resistor/electrode assembly and the high voltage output of either the cable or the internal multiplier circuit is maintained.

The electrostatic spray gun constructed according to the principles of the present invention uses the same housing with internal chamber, retainer, gun resistor and discharge electrode, trigger, and nozzle regardless of whether the high voltage cable or internal voltage multiplier is used. By using the same gun construction for both high voltage type guns, the parts inventory is materially reduced from that previously required when different gun constructions were used for the different types of guns.

These and other objects and advantages of the present invention shall be made apparent from the accompanying drawings and the description thereof.

DETAILED DESCRIPTION OF THE INVENTION

Figure 1A:
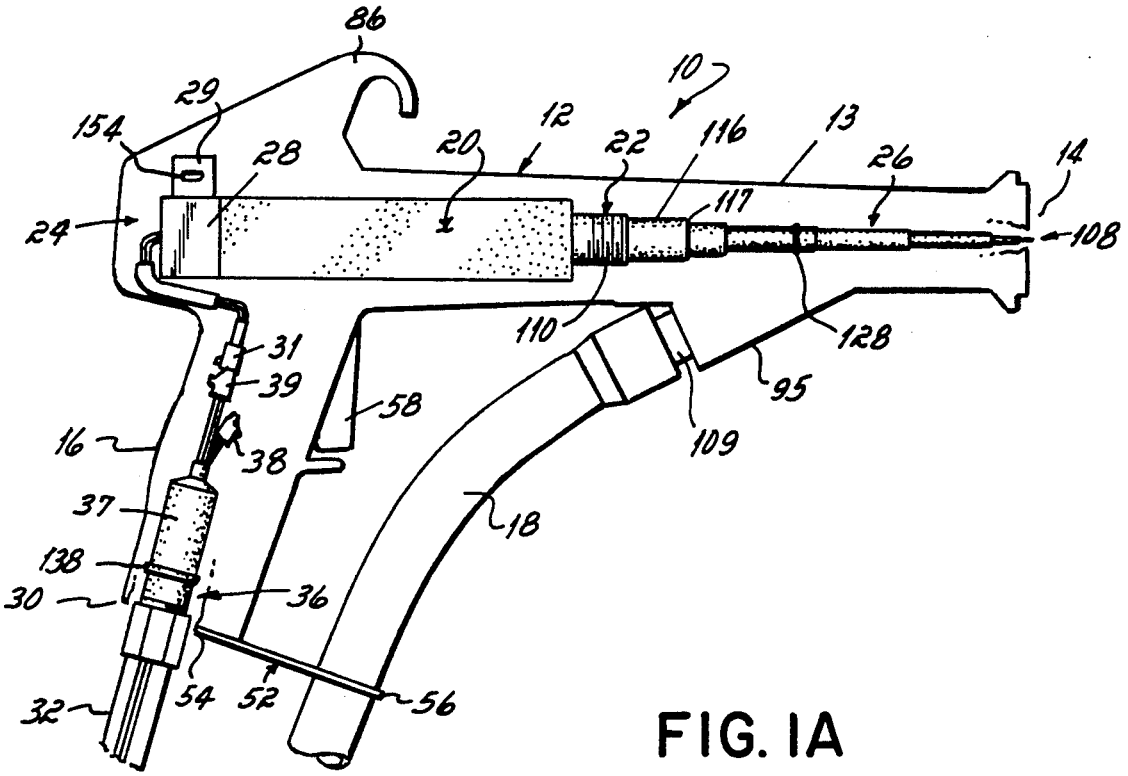
FIG. 1A shows an electrostatic spray gun constructed according to the principles of the present invention having an internal high voltage power supply mounted therein.

In FIG. 1A, an electrostatic spray gun 10 configured to operate with an internal voltage multiplication circuit or internal voltage multiplier 20 is shown. Gun 10 has a pistol-shaped housing 12 with a barrel 13 terminating at a discharge end 14 and a handle 16. A conduit 18 brings the coating material to be charged into housing 12 proximate discharge end 14. Within housing 12 is an internal voltage multiplier 20 having a forward end 22 and a rearward end 24. Mounted to the forward end 22 of multiplier circuit 20 is an resistor/electrode assembly 26. At the rearward end 24 of internal voltage multiplier 20, a heat conductive band 28 comprised of a band of thermally conductive material and having a tab 29 extending therefrom, is mounted for the transfer of heat generated by internal voltage multiplier 20.

Extending from the rear of internal voltage multiplier 20 in FIG. 1A are three insulated conductors that are connected to a three pin plug 31. Secured by annular flanges and recesses in an aperture at the lower end 30 of handle 16 is a cable mounting collar 36 having a bore therein through which a low voltage power supply cable 32 extends. The portion of cable mounting collar 36 housed within handle 16 is surrounded by an insulating boot 37 that tapers to a narrow opening through which two groups of insulated conductors extend that terminate into a two-pin and a three-pin plug 38, 39, respectively. Plug 39 mates with plug 31 to provide an electrical connection from a remote low voltage power supply (not shown) to voltage multiplier 20. Alternatively, a low voltage dc source, such as a battery located within the gun, could supply low voltage to internal voltage multiplier 20 through plug 31.

Figure 1B:
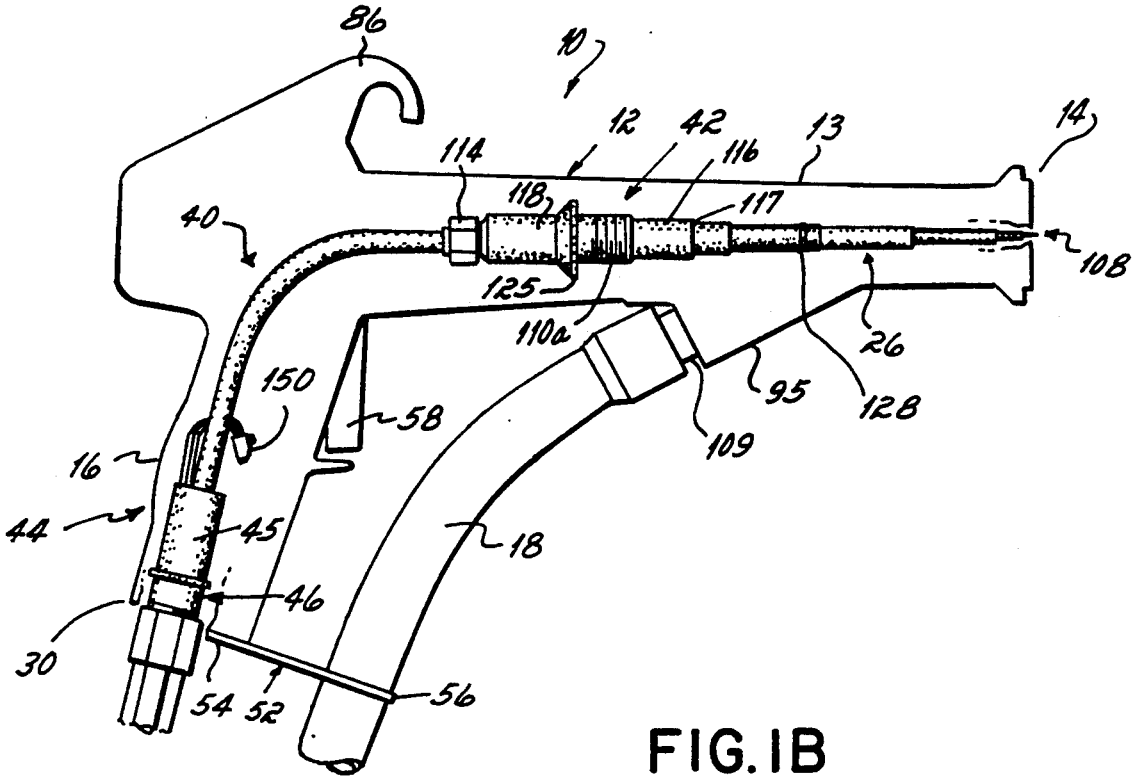
FIG. 1B shows the electrostatic spray gun of FIG. 1A having the end section of a high voltage cable mounted within the gun.

Using like numerals for like structural elements, FIG. 1B shows the electrostatic spray gun 10 of FIG. 1A configured to operate with an external high voltage power supply (not shown) using a high voltage cable 40 having one end connected to the external high voltage supply and the other end of the high voltage cable 40 mounted within gun 10. Gun 10 again includes a pistol-shaped housing 12 having a discharge end 14 and handle 16 with discharge end 14 being supplied coating material via conduit 18. Forward end 42 of high voltage cable 40 is connected to resistor/electrode assembly 26 while rearward section 44 extends through a bore in cable mounting collar 46 to the external high voltage supply. Like cable mounting collar 36, cable mounting collar 46 is secured by annular flanges and recesses within an opening in lower end 30 of handle 16. An insulating boot 45 covers cable mounting collar 46 within handle 16. As can be seen in the comparison of FIGS. 1A and 1B, internal voltage multiplier 20 and externally supplied high voltage cable 40 reside in approximately the same location within housing 12 of gun 10.

Figure 2:
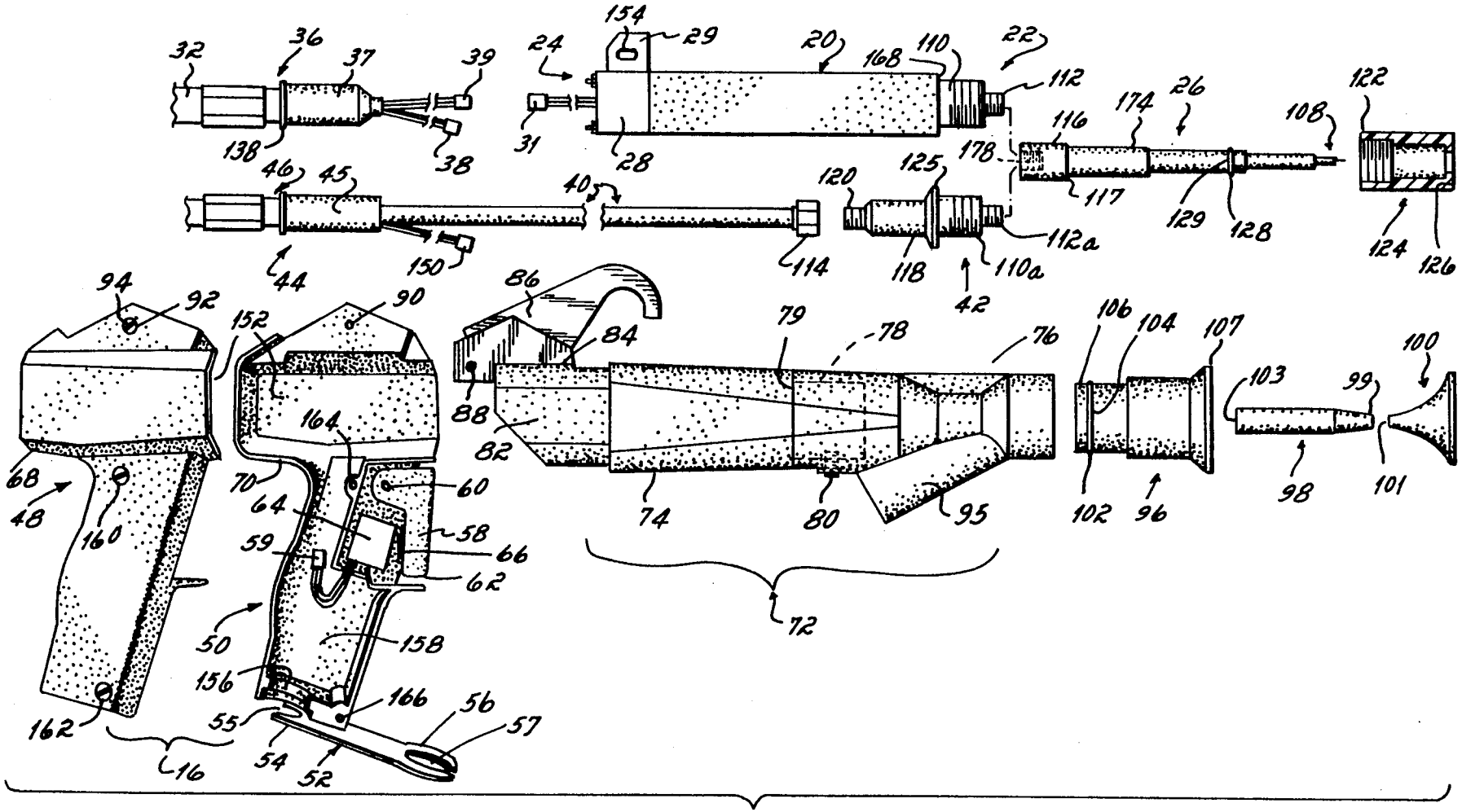
FIG. 2 is an exploded view of the gun components and the alternative high voltage supply components, namely, the internal voltage multiplier and the externally supplied high voltage cable.

Referring now to FIG. 2, the various components of electrostatic spray gun 10 are explained. Handle 16 has two mateable sections 48 and 50 preferably constructed of electrically conductive, impact resilient plastic material such as carbon-filled nylon. Handle section 50 has a cable holder 52 in the form of an elongated flat metal plate having a rearward end 54 which is attached to lower end 30 of handle section 50 by screws or the like (not shown) and a distal end 56 extending outwardly from handle 16 which has an opening 57 through which conduit 18 (FIG. 3) passes. Cable holder end 54 has an opening 55 into which cable mounting collar 36 or 46 is secured depending upon whether a low voltage cable or a high voltage cable enters the lower end of the handle. Outside walls 68 and 70 of handle sections 48 and 50 are constructed to provide recessed areas 152 and 158 to collectively form an internal chamber in handle 16 when handle sections 48 and 50 are mated together. This internal chamber alternatively provides a) a passageway for low voltage cable 32 and a repository for rearward end 24 of internal voltage multiplier 20 when gun 10 is electrically supplied by an external low voltage dc source, or b) a passageway for high voltage cable 40 when gun 10 is supplied by an external high voltage source. Handle section 50 also includes an inverted L-shaped trigger 58 which is mounted at the free end of its base about a pivot pin 60 which is anchored to the handle section 50. Outer trigger end 62 lies adjacent a lever 66 extending from electrical switch 64 mounted to handle section 50 between trigger 58 and recessed area 158 in handle section 50. Pivoting trigger 58 about pin 60 pushes lever 66 towards switch 64 to open and close electrical switch 64. When the insulated conductor pair ending in two-pin plug 59 that extends from switch 64 is connected to plug 38 of low voltage cable 32 or two-pin plug 150 of high voltage cable 40, depending upon which cable is used, the opening and closing of switch 64 via trigger 58 controls the input of voltage to internal voltage multiplier 20 or the forward end 42 of high voltage cable 40, respectively.

Further referring to FIG. 2, gun barrel 12 comprises an elongated sleeve 72 having an exterior polygonal shape. Sleeve 72 has a forward section 76 and a rearward section 74 having an internal bore which is rectangular in cross-section to receive either internal voltage multiplier 20 or forward end section of high voltage cable 40 in a manner discussed below. Rearward section 74 has a rearward area 82 which fits within recessed area 152 of handle sections 48 and 50 to extend the internal chamber in handle 16 into sleeve 72. Transverse wall 79 in reduced diameter extension 78 (shown in dotted lines) of barrel section 74 terminates the internal chamber. Attached by screws 83 (FIGS. 3 and 5) in upper surface 84 of rearward section 82 is a support hook 86. When reduced section 82 is placed between handle sections 48 and 50, hole 88 in support hook 86 and holes 90 and 92 in handle sections 50 and 48, respectively, align so screw 94 may be received into the aligned holes to secure handle sections 48, 50 about barrel section 74. Barrel portions 74 and 76 are preferably constructed of electrically nonconductive, impact resilient plastics while support hook 86 is preferably made from a thermally conductive material, such as aluminum, to assist in heat dissipation from the gun as is explained below.

Again with reference to FIG. 2, forward barrel section 76 is shown in place about extension 78 and secured to extension 78 by a set screw 80 or the like. Extending from the lower side of barrel section 76 is a material intake chute 95 that provides external access to the bore centrally located within barrel section 76. The bore within barrel section 76 communicates with the internal chamber extending into barrel section 74 through an opening 169 in transverse wall 79 of extension 78 in a manner described in greater detail below. Nozzle 96 has a rearward section 106 with a diameter that is less than the diameter of the bore in barrel section 76 and a forward section 107 that has an outside diameter approximately the same as the outside diameter of barrel section 76. An O-ring seal 102 located in annular groove 104 in rearward end 106 of nozzle 96 holds nozzle 96 in place at the forward end of barrel section 76 when rearward section 106 is inserted into the bore of barrel section 76 so forward section 107 of nozzle 96 abuts the forward end of barrel section 76.

FIG. 2 further shows a tubular deflector stem 98 having a sloping nose 99 at its forward end. A portion of resistor/electrode assembly 26 extends from the forward end of deflector stem 98 to frictionally mount deflector 100. When assembled, electrode 108 of resistor/electrode assembly 26 extends slightly beyond the large end of funnel-shaped deflector 100. A narrow opening 101 at the rearward end of funnel-shaped deflector 100 can be slid rearwardly over the extending end of resistor/electrode assembly 26 and is frictionally secured thereto. A passageway within deflector stem 98 has a stair-stepped diameter to coincide with the forward stair-stepped diameter segments of the tubular resistor/electrode assembly 26. By pushing the forward end of resistor/electrode assembly 26 into opening 103 at the rearward end of deflector stem 98, the deflector stem is frictionally secured about resistor/electrode assembly 26.

As shown in FIG. 2, internal voltage multiplier 20 has a rectangular body with heat conductive band 28 mounted at its rearward end 24 and a telescoping threaded front end having two segments 110 and 112 The electrical construction of internal voltage multiplier 20 is generally known within the art and may include a step-up transformer, an oscillator and a capacitor/diode cascade (all not shown) to provide a high voltage dc output to resistor/electrode assembly 26 from the low voltage input supplied to internal voltage multiplier 20 through the insulated conductor pair connected to three-pin plug 31.

Threaded segment 110 is intermediate the forwardmost threaded segment 112 of internal voltage multiplier 20 and the front edge 168 of the rectangular body of voltage multiplier 20. Threaded segment 110 has an outside diameter greater than that of the rearmost segment 116 of resistor/electrode assembly 2 so when resistor/electrode assembly 26 is threaded onto threaded segment 112, segment 116 of resistor/electrode assembly 26 abuts threaded segment 110. When internal voltage multiplier 20 is placed within the internal chamber formed by recessed areas 152 in handle sections 48, 50 and which continues into rectangular chamber 167 of barrel section 74, front shoulder 168 of voltage multiplier 20 abuts internal wall 79 that extends transversely across the barrel interior at the forward end of the internal chamber (FIG. 4) and threaded extensions 110, 112 of internal voltage multiplier 20 extend through the opening 169 in wall 79 (FIG. 4) into extension 78. Tubular retainer 124 having an interiorly threaded rearward end 122 is slid along resistor/electrode assembly 26 mounted to threaded extension 112 until the inner threads of retainer 124 engage the outer threads of threaded extension 110. Retainer 124 is turned onto threaded extension 110 until rear end 122 of retainer 124 engages the forward face of internal wall 79. Thus assembled, internal voltage multiplier 20 is mounted to wall 79 to secure voltage multiplier 20 and resistor/electrode assembly 26 within gun 10.

Figures 3, 4:
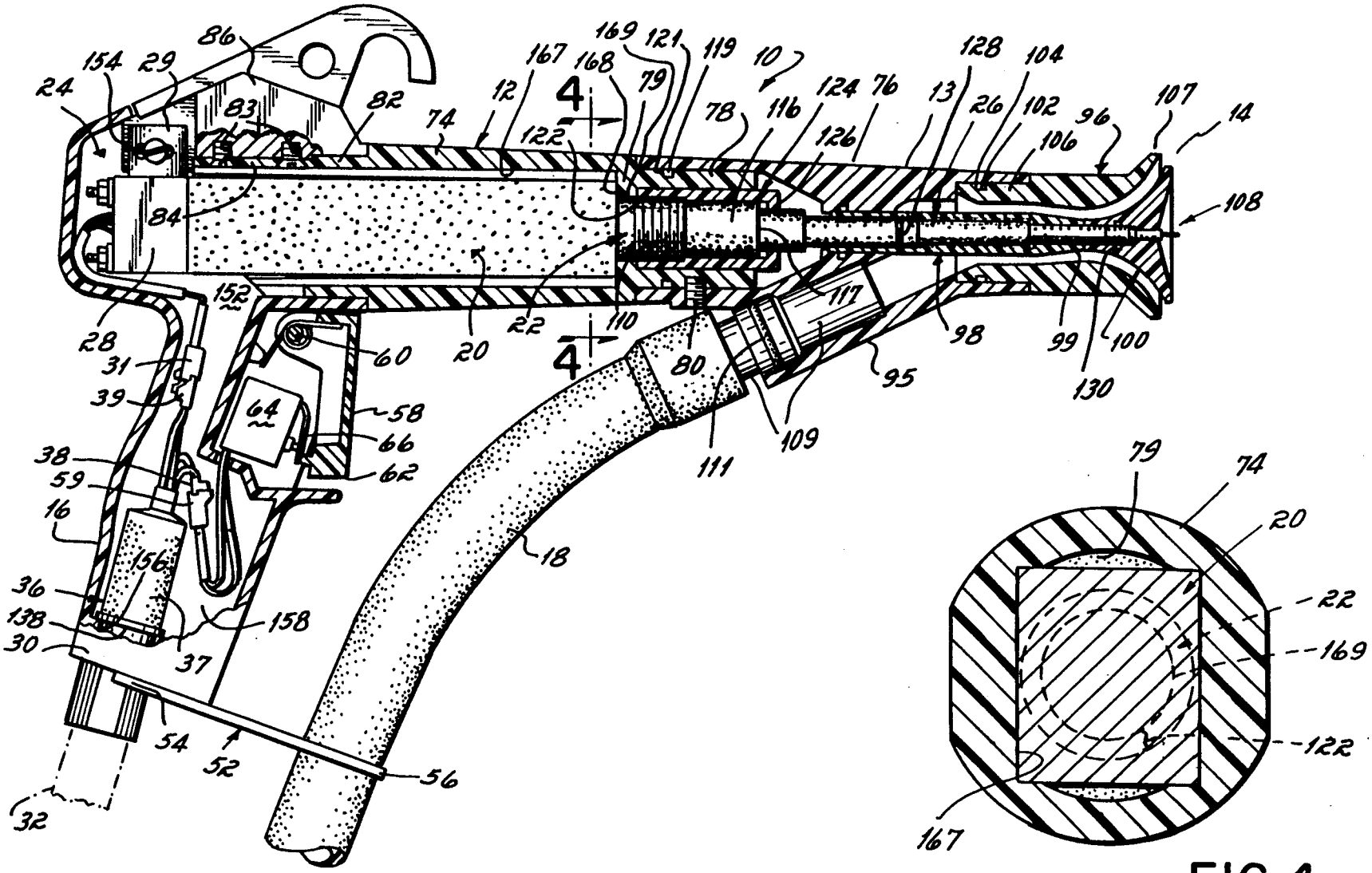
FIG. 3 is a longitudinal cross section of the electrostatic spray gun constructed according to the principles of the present invention having an internal voltage multiplier mounted therein.
FIG. 4 is a cross sectional view of the barrel of the gun taken along lines 4—4 of FIG. 3.

FIGS. 3 and 4 show a cross section of the assembled gun 10 with internal voltage multiplier 2 mounted therein. The cross section of internal voltage multiplier 20 is substantially rectangular so internal voltage multiplier 20 does not rotate about its longitudinal axis within the inner volume of rear barrel section 74. This is done to prevent internal voltage multiplier 20 from rotating within barrel section 74 when retainer 124 is threaded onto and off of threaded extension 110 of internal voltage multiplier 20. Since internal voltage multiplier 20 cannot rotate within barrel section 74, internal voltage multiplier 20 remains mounted to wall 79 by retainer 124 to ensure the electrical contact between the high voltage output of internal voltage multiplier 20 and resistor/electrode assembly 26 is maintained. Forward end 126 of retainer 124 is precluded from engagement with front shoulder 117 of rearmost segment 116 of resistor/electrode assembly 26 to ensure that rear end 122 of retainer 124 engages wall 79. To prevent axial displacement of resistor/electrode assembly 26, assembly 26 has internal threads 178 at its rear end which are threaded onto extension 112 at forward end 22 of internal voltage multiplier 20. In this manner, retainer 124 secures resistor/electrode assembly 26 and internal voltage multiplier 20 within gun 10 to protect the electrical connection between these two components.

Cable retaining plug 118, shown in FIG. 2, is constructed in a similar fashion to the forward section of internal voltage multiplier 20 to nonrotationally fit within the internal chamber 167 of barrel section 74. Cable retaining plug 118 includes a tubular nonconductive body having a stair-stepped outside diameter and has a threaded forward end 42 that corresponds in function to the threaded forward end 22 of internal voltage multiplier 20. Specifically, end 42 includes a large threaded extension 110*a* and a second smaller threaded extension 112*a*. The plug 118 also has a rearward threaded end 120, and an electrical conductor (not shown) snugly secured within a centrally located bore extending between the two threaded ends 42, 120. Retaining plug 118 is connected to high voltage cable 40 by cable nut 114 which is concentrically mounted at the forward end of high voltage cable 40. By threading cable nut 114 about threaded end 120 of retaining plug 118, an electrical path is established between the forward end 42 of the conductor located within retaining plug 118 to the external high voltage source via the high voltage cable 40 and the conductor within retainer plug 118. When resistor/electrode assembly 26 is mounted to forward end 42 in the same manner as it was to forward end 22 of voltage multiplier 20, the high voltage output present at the forward end of the conductor within plug 118 is conducted to electrode 108 via the gun resistor within assembly 26.

Figure 6:
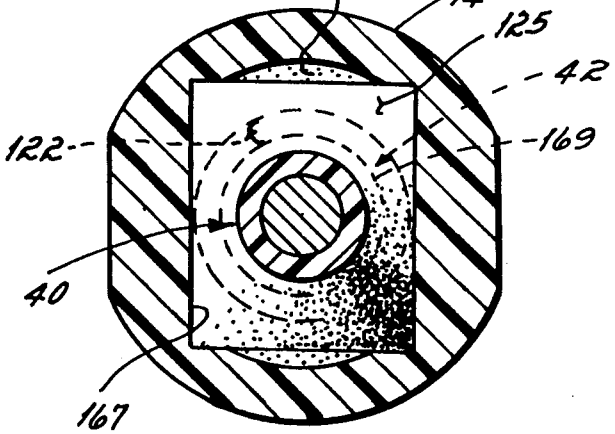
FIG. 6 is a cross sectional view of the electrostatic spray gun taken along lines 6—6 of FIG. 5.

Between threaded ends 120, 42, cable retaining plug 118 has a rectangular cross-section collar 125 being configured to fit within internal chamber 167 as did the body of internal voltage multiplier 20. The high voltage cable is operatively positioned in the gun by locating cable mounting collar 46 within annular groove 156 of handle section 50, positioning high voltage cable 40 within the internal chamber of handle 16 and rearward barrel section 74, and inserting threaded extension 110*a* of end 42 through opening 169 of wall 79. Plug 118 is held against rotation by the interfit of the similarly shaped collar 125 and the internal chamber 167 of barrel section 74. In this position, rectangular collar 125 abuts wall 79 just as front shoulder 168 does when internal voltage multiplier 20 is placed within the internal chamber. When retainer 124 is threaded onto threaded extension 110*a* of cable retaining plug 118 which corresponds in function to threaded extension 110 of internal voltage multiplier 20, cable retaining plug 118 and resistor/electrode assembly 26 are maintained in fixed axial relation to wall 79 to prevent uncoupling the forward end of retaining plug 118 and the rearward end of resistor/electrode assembly 26 (FIG. 6) thereby insuring continued electrical connection between the conductor within plug 118 and the gun resistor.

The similarity in construction of the forward portion of retaining plug 118 and the forward section of internal voltage multiplier 20 permits gun 10, and in particular the gun electrode, to be alternatively provided with high dc voltage from either an external high dc voltage power supply via high voltage cable 40 or an internal voltage multiplier 20 having a high dc voltage output.

FIG. 3 shows an assembled electrostatic spray gun 10 with internal voltage multiplier 20 mounted therein. Electrical plug 38 is connected to electrical plug 59 whose insulated conductor leads to electrical switch 64 so the input of voltage from the external low dc voltage source supplied through cable 32 may be controlled via trigger 58. Electrical plug 39 is connected to three-pin plug 31 to provide the low dc voltage input to internal voltage multiplier 20. Internal voltage multiplier 20 is placed within recessed portion 152 of handle section 50 so that hole 154 of tab 29 extending from heat conductive band 28 aligns with hole 90 of handle section 50. Rear barrel section 74 is placed about internal voltage multiplier 20 so hole 88 of hook support 86 is aligned with holes 154 and 90. Annular flange 138 of cable mounting collar 36 is placed within groove 156 and the insulated conductive leads extending from cable 32 through mounting collar 36 are placed within the recessed area 158 of handle section 50. Handle section 48 is placed over handle section 50 so that screws 94, 160 and 162 extend to and are received by holes 90, 164, and 166 in handle section 50 (FIG. 2), respectively. Screws 94, 160 and 162 secure handle sections 48 and 50 about cable mounting collar 36 and reduced diameter section 82 of rear barrel section 74. Heat conductive band 28 is thus thermally connected to support hook 86 so heat produced by internal voltage multiplier 20 is conducted through heat conductive band 28 and tab 29 to support hook 86 and from there the heat is dissipated into the surrounding air.

The assembled gun of FIG. 3 further shows resistor/electrode assembly 26 screwed onto forward end 22 of internal voltage multiplier 20 and retainer 124 secured onto the threads of extension 110 about the base of resistor/electrode assembly 26 to mount internal voltage multiplier 20 to wall 79 within rear barrel section 74. Forward barrel section 76 frictionally grips extension 78 with O-ring seal 119 mounted within annular groove 121 located on extension 78 of barrel section 74 at its rearward end. Barrel section 76 is secured about extension 78 with set screw 80. Conduit 18 is inserted through the opening 57 at distal end 56 of cable holder 52 and connected to conduit connector 109 held within material intake chute 95 by O-ring seal 111. Nozzle 96 is seated within forward barrel section 76 so that O-ring seal 102 engages the internal walls of forward barrel section 76. Deflector stem 98 is installed on the outside diameter of resistor/electrode assembly 26 and frictionally secured thereon by O-ring seal 128. Deflector 100 is frictionally slid onto resistor/electrode assembly 26 into abutment with sloping nose 99 to complete the assembly of gun 10. Deflector 100 is frictionally held in place by an O-ring seal 130 mounted within deflector 100. To disassemble gun 10 with internal voltage multiplier 20 mounted therein, the gun components are removed in reverse order.

Figure 5:
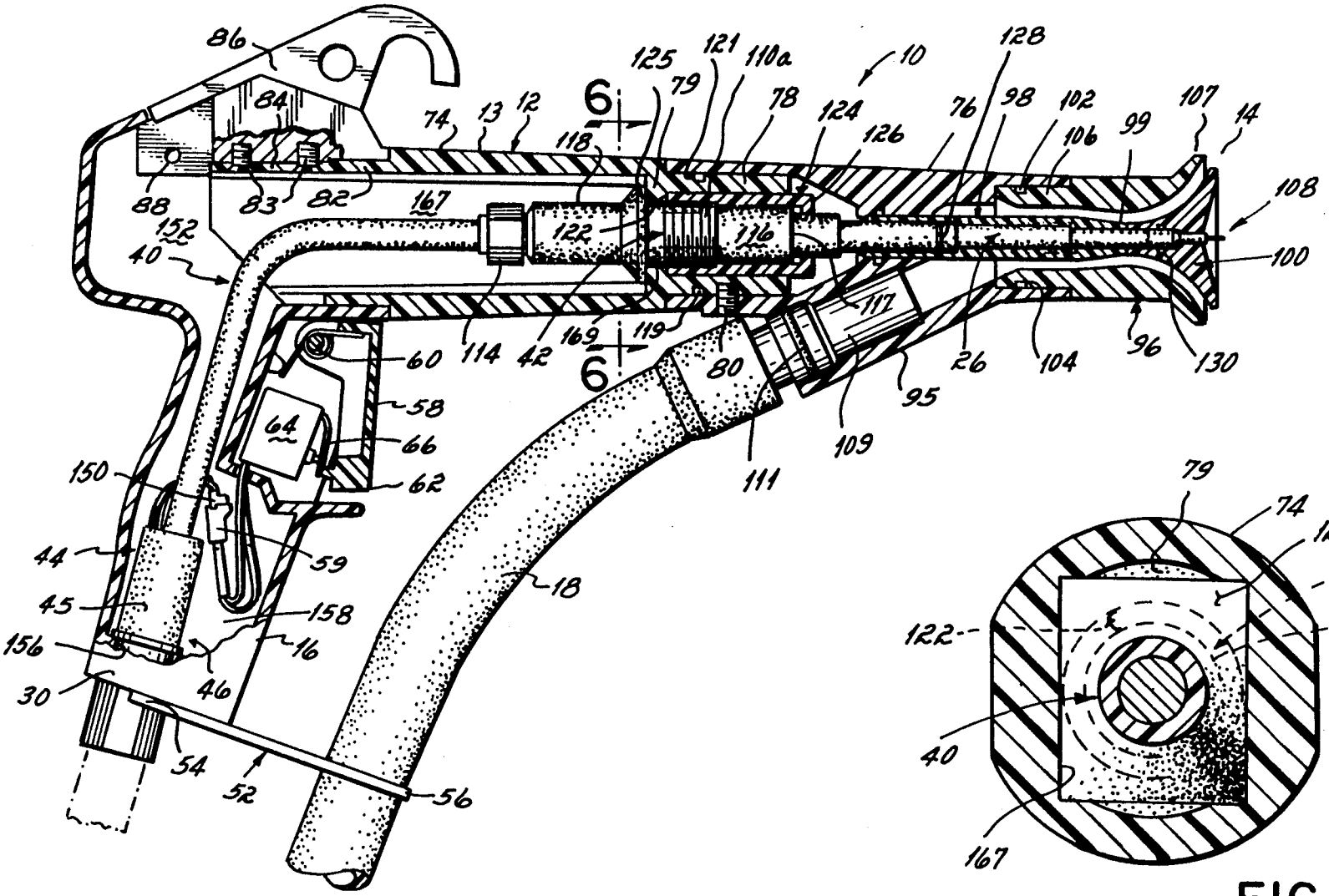
FIG. 5 is a longitudinal cross section of an electrostatic spray gun constructed according to the principles of the present invention having an externally powered high voltage cable mounted therein.

Gun 10 may be reassembled with the high voltage cable as shown in FIG. 5. To so assemble gun 10, cable retainer plug 118 is screwed onto high voltage cable 40 with nut 114 and high voltage cable 40 is placed within the recessed portions of handle section 50 so that annular flange 200 of cable mounting collar 46 rests within annular groove 156 of handle 16. Rear barrel section 74 is placed about high voltage cable 40 so forward threaded end 42 of cable plug 118 extends into extension 78 and hole 88 of hook support 86 aligns with hole 90 of handle section 50. Trigger plug 150 extending from high voltage cable 40 is attached to electrical plug 59 whose insulated conductor is connected to electrical switch 64. Handle section 48 is placed over handle section 50 so that screws 94, 160 and 162 (FIG. 2) can be tightened to secure the handle sections about cable mounting collar 46 and the reduced diameter section 82 of barrel section 74 between them. Collar 125 of cable plug 118 rests against wall 79 within rear barrel section 74 and forward end 42 extends into extension 78. Resistor/electrode assembly 26 is screwed onto forward end 42 of plug 118 and retainer 124 is screwed onto threaded extension 110*a* of plug 118 at the base of resistor/electrode assembly 26 to secure plug 118 and the forward end of high voltage cable 40 to wall 79 within internal chamber 167. Forward barrel section 76 is placed about extension 78 so O-ring seal 119 grips extension 78 and set screw 80 is tightened to secure barrel portions 74 and 76 together. Conduit 18 is slid through opening 57 in the end 56 of cable holder 52 and connected to conduit connector 109. Nozzle 96, deflector stem 98 and deflector 100 are assembled in the forward end of barrel section 76 as previously described for the assembled gun shown in FIG. 3. The electrostatic spray gun 10 is now powered remotely from a high voltage dc power supply through high voltage supply cable 40. The only components differing from the assembled gun of FIG. 5 and the assembled gun with the internal voltage multiplier 20 shown in FIG. 3 are those associated with the alternative high voltage sources. In this fashion, handle sections 48, 50, hook member 86, barrel sections 74, 76, resistor assembly 26, nozzle 96 and deflector elements 98 and 100 are the same regardless of the nature of the high voltage source used.

Figure 7:
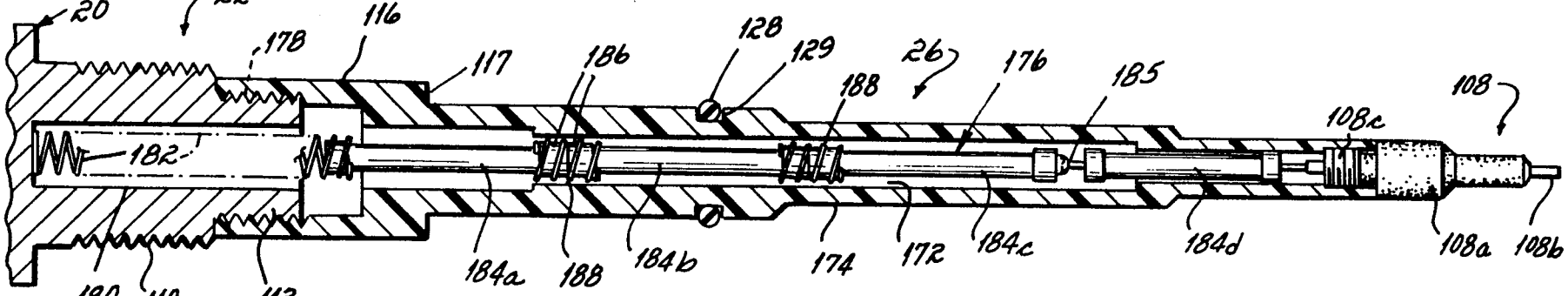
FIG. 7 is a longitudinal cross section of the gun resistor housing showing the gun resistor within the housing and the electrode module threaded onto the forward end of the gun resistor housing.

FIG. 7 shows in more detail the connection of resistor/electrode assembly 26 to forward end 22 of internal voltage multiplier 20. Resistor/electrode assembly 26 has a tubular resistor housing 174 having a stair-stepped outside diameter. O-ring seal 128 is mounted within annular groove 129 in resistor housing 174 to grip deflector stem 98 when the nozzle of gun 10 is assembled. Resistor structure 176 lies within cylindrical cavity 172 of resistor housing 174. Electrode module 108 has a non-conductive electrode mount 108*a* secured about electrode 108*b* that extends forwardly and rearwardly of electrode mount 108*a*. Module 108 is threadably secured to housing 174 by threads 108*c*.

Resistor/electrode assembly 26 is constructed by filling cavity 172 of the tubular resistor housing 174 with dielectric grease and inserting resistor structure 176 into cavity 172 from end 178 having the larger opening. Cavity 180 in forward end 22 of internal voltage multiplier 20 is filled with dielectric grease and conductive spring 182 is inserted into cavity 180 and resistor holder 174 screwed onto threads 112 of forward end 22 of internal voltage multiplier 20. As resistor/electrode assembly 26 is tightened onto the forward end of internal voltage multiplier 20, spring 182 is compressed to insure a solid electrical connection is made between internal voltage multiplier 20 and resistor structure 176. The dielectric grease evacuates the air from the cavities 172 and 180 to prevent any dielectric breakdown of air within either cavity that would produce arcing and eventually short out the internal voltage multiplier 20. Electrode module 108 is screwed onto the narrow forward end of resistor holder 174 so the rearwardly extending end of electrode 108*b* makes a solid electrical contact with resistor structure 176 to complete resistor/electrode assembly 26. In the preferred embodiment of the present invention, the dielectric grease is denoted by Part No. PE-PJ Code 4562 and is manufactured by Penreco of Butler, Pa. Forward end 42 of cable plug 118 is constructed in substantially the same manner as forward end 22 of internal voltage multiplier 20 to permit the same connection of resistor/electrode assembly 26 to high voltage cable retaining plug 40.

Figure 8:
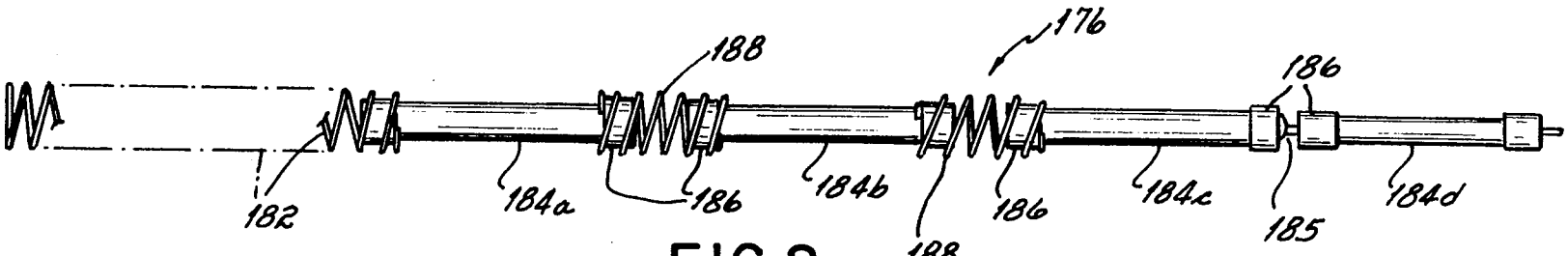
FIG. 8 shows details of the gun resistor.

FIG. 8 shows the resistor structure 176 that is inserted in resistor holder 174 to form resistor/electrode assembly 26. Gun resistors 184 have caps 186 at each end with the two forwardmost resistors 184*c,d* being rigidly connected to one another. The connections between the remaining resistors 184 are made by soldering conductive springs 188 between successive resistor caps 186. Compression spring 182 is soldered to the rearmost resistor 184*a*. The connecting springs 188 reduce the risk of breakage caused by any side loading upon the resistor structure.

While the above description constitutes a preferred embodiment of the invention, it is to be understood that the invention is not limited to this precise form and the changes may be made therein without departing from the scope of the invention. Therefore, I do not intend to be limited except by the scope of the following appended claims. Various changes can be made without departing from the scope of the invention as particularly pointed out and distinctly claimed in the appended claims.

What is claimed:

1. An electrostatic spray gun for electrostatically charging coating material emitted from the nozzle thereof comprising:

a housing having an internal chamber capable of alternatively housing a) an internal voltage multiplication circuit powered from a remote external low voltage source for producing high dc voltage at its output and b) the end section of a high voltage cable powered from a remote external high voltage source;

a gun resistor and charging electrode assembly mounted within said housing, said gun resistor and charging electrode assembly includes a charging electrode proximate said nozzle and a gun resistor positioned remote from said nozzle, said charging electrode and said gun resistor being electrically connected; and securing means for alternatively securing said internal voltage multiplication circuit and said end section of said high voltage cable within said internal chamber to selectively connect high dc voltage to said gun resistor and charging electrode assembly and power said charging electrode on an alternative basis, from either an external low voltage source via said internal voltage multiplication circuit or an external high voltage source, to thereby electrostatically charge coating material emitted from said gun nozzle.

2. An electrostatic spray gun for electrostatically charging coating material emitted from the nozzle thereof, comprising:

a housing having an internal chamber;

an internal voltage multiplication circuit for supplying a high dc voltage at its output converted from a low voltage source at its input;

a high voltage cable having an end section for supplying a high voltage to said gun from an external high voltage source remote from said gun;

a gun resistor and charging electrode assembly mounted within said housing, said gun resistor and charging electrode assembly includes a charging electrode proximate said nozzle and a gun resistor positioned remote from said nozzle, said charging electrode and said gun resistor being electrically connected; and securing means for alternatively securing said internal voltage multiplication circuit and said end section of said high voltage cable within said internal chamber to selectively connect high dc voltage to said gun resistor and charging electrode assembly and power said charging electrode on an alternative basis from either a low voltage source via said internal voltage multiplication circuit or an external high voltage source, to electrostatically charge coating material emitted from said gun nozzle.

3. The electrostatic spray gun of claim 2 further comprising:

a thermally conductive heat dissipation member having a substantial portion thereof located exteriorly of said housing, said heat dissipation member having an integral mounting member in contact with said housing;

a thermally conductive band surrounding at least a portion of said voltage multiplication circuit, said thermally conductive band having a thermally conductive tab extending therefrom; and means for fastening said tab and said thermally conductive heat dissipation member together to thereby place said thermally conductive band in heat transfer relation to said thermally conductive heat dissipation member.

4. The electrostatic spray gun of claim 3 wherein said substantial portion of said thermally conductive heat dissipation member includes a hook element to facilitate externally supporting said gun.

5. The electrostatic spray gun of claim 2 wherein:

said end section of said high voltage cable includes a retaining plug to electrically interconnect said high voltage cable and said gun resistor and charging electrode assembly, said retaining plug and said internal voltage multiplication circuit are configured relative to said internal chamber to prevent rotation of said internal voltage multiplication circuit and said retaining plug within said internal chamber.

6. An electrostatic spray gun for electrostatically charging coating material emitted from the nozzle thereof, comprising:

a housing having an internal chamber;

a voltage multiplication circuit mounted within said housing which generates heat;

a thermally conductive band within said internal chamber to collect heat generated by said voltage multiplication circuit, said thermally conductive band being in heat transfer relation to said voltage multiplication circuit and having a tab extending therefrom;

heat dissipation means mounted to said housing, said heat dissipation means having a substantial portion located outside said housing; and a first fastener to secure said tab extending from said thermally conductive band to said heat dissipation means so said collected heat is transferred from said thermally conductive band through said tab to said heat dissipation means to transfer to the environment heat collected within said internal chamber generated by said multiplication circuit.

7. The electrostatic spray gun of claim 6 further comprising:

said housing includes a handle section and a barrel section, said first fastener secures said tab extending from said thermally conductive band and said heat dissipation means to said handle section; and a second fastener for securing said heat dissipation means to said barrel section such that said barrel section and said handle section are held together by said heat dissipation means.

8. An electrostatic spray gun alternatively housing one of an internal voltage multiplier having a high dc voltage output and an end section of a high voltage cable connected at its other end to an external high voltage source remote from said housing comprising:

a spray gun housing having an internal chamber, said spray gun housing including, a barrel having an interior therethrough, a transverse wall in said interior of said barrel to divide said interior into a forward portion of said internal chamber and a bore located forward of said wall, said wall having an aperture therein so said forward portion of said internal chamber communicates with said bore;

a gun resistor having a forward and rearward end, said rearward end being mountable to the forward end of one of said internal voltage multiplier or said end section of said high voltage cable extending through said aperture in said wall separating said internal chamber from said bore thereby electrically connecting said gun resistor to one of said internal voltage multiplier or said end section of said high voltage cable housed within said internal chamber; and retaining means abutting said wall separating said internal chamber from said bore and engaging said forward end of one of said internal voltage multiplier and said end section of said high voltage cable so that said forward end of said internal voltage multiplier and said end section of said high voltage cable housed within said internal remain electrically connected to said gun resistor.

9. An electrostatic spray gun for electrostatically charging coating material emitted from the nozzle thereof, comprising:

a housing having an internal chamber;

an electrode proximate the nozzle for electrostatically charging the coating material;

an internal voltage multiplier connectable at its input end to a low voltage and having a high voltage dc output which can be selectively electrically connected to said electrode when said internal voltage multiplier is located within said internal chamber; and a high voltage cable having a remote end connectable to an external high voltage dc supply and an opposite end having a high voltage dc output which can be selectively electrically connected to said electrode when said opposite end of said high voltage cable is located within said internal chamber of said housing, said internal chamber of said housing being configured for alternatively housing said internal voltage multiplier and said opposite end of said high voltage cable to permit, on an alternative basis, said opposite end of said high voltage cable or said internal voltage multiplier high voltage dc output to be connected to said electrode to supply high dc voltage from either said remote high voltage dc supply or said internal voltage multiplier, respectively.

10. The gun of claim 9 further comprising:

detachable mounting means forward of said internal chamber for detachably mounting said opposite end of said high voltage cable and said internal voltage multiplier within said housing.

11. The gun of claim 10 further comprising:

interlocking means mounted to each of said internal voltage multiplier and said opposite end of said high voltage cable to prevent rotation relative said internal chamber of said housing of each of said opposite end of said high voltage cable and said internal voltage multiplier.

12. An electrostatic spray gun for electrostatically charging coating material emitted from the nozzle thereof comprising:

a housing having an internal chamber capable of alternatively housing a) an internal voltage multiplication circuit powered from a remote external low voltage source for producing high dc voltage at its output and b) the end section of a high voltage cable powered from a remote external high voltage source;

a barrel connected to said housing;

a charging electrode secured proximate said nozzle; and securing means for alternatively securing said internal voltage multiplication circuit and said end section of said high voltage cable within said internal chamber of said housing to selectively connect high dc voltage through an electric circuit means to said charging electrode so that said charging electrode can be powered on an alternative basis, from either an external low voltage source via said internal voltage multiplication circuit or an external high voltage source, to thereby electrostatically charge coating material emitted from said gun nozzle.

13. The electrostatic spray gun of claim 12 wherein said electric circuit means includes a resistor.

14. An electrostatic spray gun for electrostatically charging coating material emitted from the nozzle thereof comprising:

a housing having an internal chamber capable of alternatively housing a) an internal voltage multiplication circuit powered from a remote external low voltage source for producing high dc voltage at its output and b) the end section of a high voltage cable powered from a remote external high voltage source;

a barrel formed as a part of said housing, a charging electrode secured proximate said nozzle; and securing means for alternatively securing said internal voltage multiplication circuit and said end section of said high voltage cable within said internal chamber of said housing to selectively connect high dc voltage through an electric circuit means to said charging electrode so that said charging electrode can be powered on an alternative basis, from either an external low voltage source via said internal voltage multiplication circuit or an external high voltage source, to thereby electrostatically charge coating material emitted from said gun nozzle.

* * * * *